United States Patent [19]

Umeda

[11] Patent Number: 4,936,278

[45] Date of Patent: Jun. 26, 1990

[54] AIR-FUEL RATIO CONTROL METHOD FOR INTERNAL COMBUSTION ENGINES

[75] Inventor: Tadashi Umeda, Wako, Japan

[73] Assignee: Honda Giken Kogyo K.K., Tokyo, Japan

[21] Appl. No.: 409,826

[22] Filed: Sep. 20, 1989

[30] Foreign Application Priority Data

Sep. 22, 1988 [JP] Japan ..... 63-237865

[51] Int. Cl.[5] ..... F02D 41/14; F02D 41/10

[52] U.S. Cl. ..... 123/489; 123/492

[58] Field of Search ..... 123/440, 478, 480, 486, 123/489, 492, 494, 589; 364/431.05

[56] References Cited

U.S. PATENT DOCUMENTS 4,488,529 12/1984 Nishida et al. ..... 123/489 X
4,561,403 12/1985 Oyama et al. ..... 123/489
4,763,629 8/1988 Okazaki et al. ..... 123/489
4,877,006 10/1989 Noguchi et al. ..... 123/489 X

FOREIGN PATENT DOCUMENTS 0029622 6/1987 Japan .

*Primary Examiner*—Willis R. Wolfe
*Attorney, Agent, or Firm*—Arthur L. Lessler

[57] ABSTRACT

An air-fuel ratio control method for an internal combustion engine, wherein when the engine is in a feedback control region, a value of concentration of oxygen detected by the $O_2$ sensor is compared with a predetermined reference value, and the air-fuel ratio of a mixture being supplied to the engine is controlled to a desired value in a feedback manner responsive to the comparison result. When the engine is in a predetermined high load operating region, the feedback control is interrrupted and an amount of fuel to be supplied to the engine is increased by a predetermined amount to thereby enrich the air-fuel ratio. The predetermined amount is increased when the engine is in the predetermined high load operating region and at the same time the detected oxygen concentration indicates that the air-fuel ratio is on a lean side with respect to the desired value.

5 Claims, 3 Drawing Sheets

(a) VO2

(b) A/F (c) KWOT

AIR-FUEL RATIO CONTROL METHOD FOR INTERNAL COMBUSTION ENGINES

BACKGROUND OF THE INVENTION

This invention relates to an air-fuel ratio control method of controlling the air-fuel ratio of a mixture being supplied to internal combustion engines, and more particularly to a method of controlling the air-fuel ratio during a high load operating condition of the engine in which the throttle valve is substantially fully open.

A method of controlling the air-fuel ratio of the mixture being supplied to the engine during a high load operating condition is known e.g. from Japanese Patent Publication (Kokoku) No. 62-29622 by the assignee of the present application, in which the intake pipe absolute pressure and the throttle valve opening are sensed, and if both the sensed absolute pressure and throttle valve opening are below respective predetermined values, the mixture is not enriched, whereas if one of the sensed absolute pressure and throttle valve opening exceeds the predetermined value, the mixture is enriched.

Recently, a gasoline called "super A gasoline" has been sold on the market, which has low volatility as compared with an ordinary gasoline such as a C gasoline. If such a gasoline having low volatility is used, it is not well atomized so that the air-fuel ratio of the mixture becomes leaner than the case when the same amount of the ordinary gasoline is used.

According to the above-mentioned conventional method, if such a low volatility gasoline is used, even when fuel to be supplied is increased so as to enrich the air-fuel ratio of the mixture during a high load operating condition of the engine in which the throttle valve is substantially fully open, a desired air-fuel ratio, e.g. 12, and hence desired combustion cannot be obtained due to the above-described tendency of leaning of the mixture, resulting in a reduction in the engine output and hence degraded driveability of the engine. This disadvantage is conspicuous especially when the engine is in an early stage of the high load condition with the throttle valve being substantially fully open, in which the degree of volatility and hence degree of atomization of the gasoline used more largely affects the air-fuel ratio because the flow speed of intake air is higher than that of the fuel.

SUMMARY OF THE INVENTION

It is the object of the invention to provide an air-fuel ratio control method for an internal combustion engine, which is capable of securing good driveability of the engine during a high load operating condition, even if a gasoline having low volatility is used.

To attain the above object, the present invention provides a method of controlling an air-fuel ratio of an air-fuel mixture being supplied to an internal combustion engine having an exhaust passage, and an exhaust gas ingredient sensor arranged in the exhaust passage, wherein when the engine is in a feedback control region, a value of concentration of an exhaust gas ingredient detected by the exhaust gas ingredient sensor is compared with a predetermined reference value, and the air-fuel ratio of the air-fuel mixture is controlled to a desired value in a feedback manner responsive to the comparison result, and when the engine is in a predetermined high load operating region, the feedback control is interrupted and an amount of fuel to be supplied to the engine is increased by a predetermined amount to thereby enrich the air-fuel ratio of the air-fuel mixture.

The method of the invention is characterized by an improvement wherein the predetermined amount is varied depending upon the value of the concentration of the exhaust gas ingredient detected by the exhaust gas ingredient sensor, when the engine is in the predetermined high load operating region.

Preferably, the predetermined amount is increased when the engine is in the predetermined high load operating region and at the same time the value of the concentration of the exhaust gas ingredient detected by the exhaust gas ingredient sensor indicates that the air-fuel ratio of the air-fuel mixture is on a lean side with respect to the desired value.

The above and other objects, features, and advantages of the invention will be more apparent from the ensuing detailed description taken in conjunction with the accompanying drawings.

DETAILED DESCRIPTION

The invention will now be described in detail with reference to the drawings showing an embodiment thereof.

Figure 1:
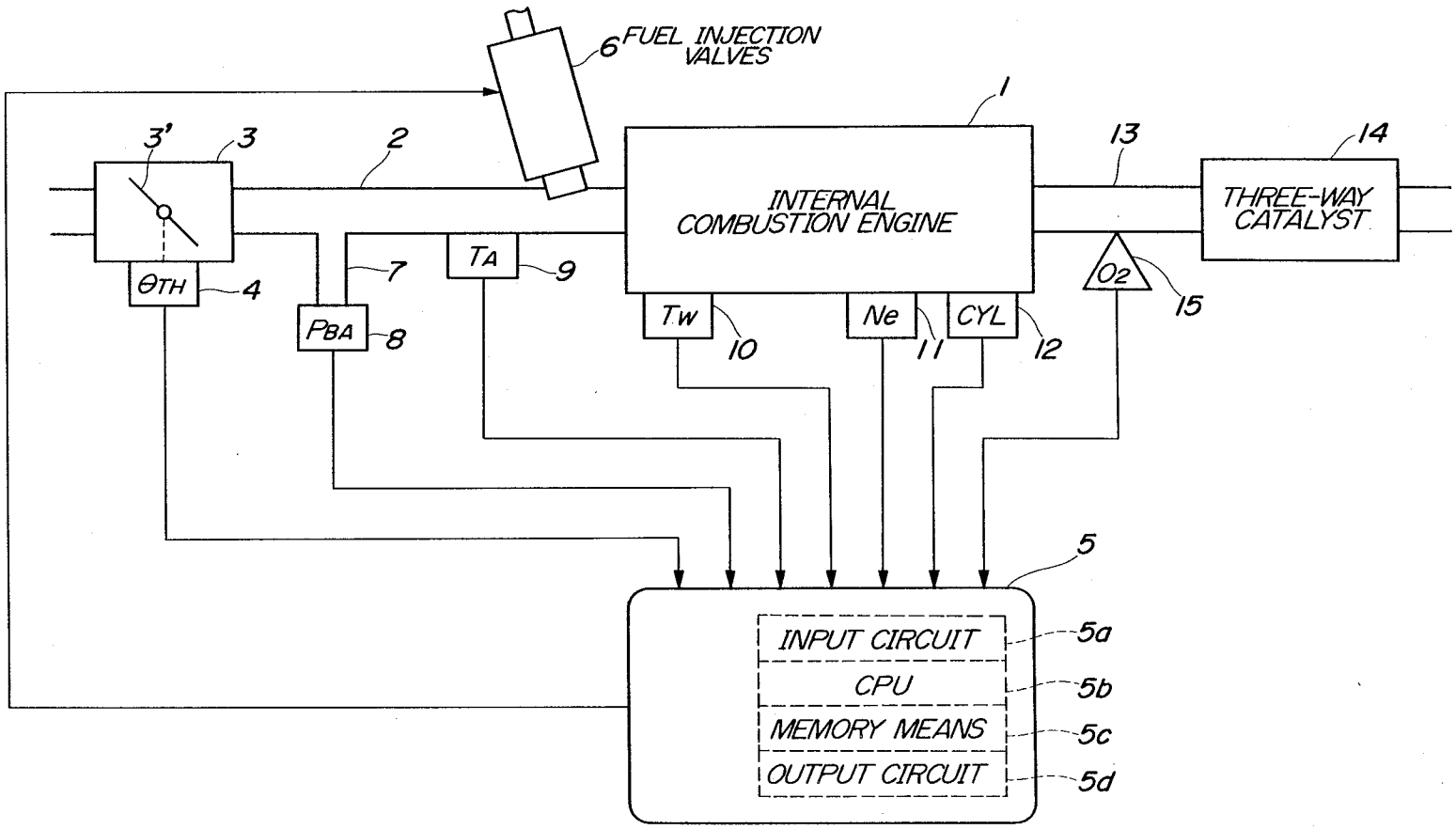
FIG. 1 is a block diagram illustrating the whole arrangement of a fuel supply control system, to which the method of the invention is applied.

Referring first to FIG. 1, there is schematically illustrated the entire arrangement of a fuel supply control system for an internal combustion engine to which the method of the invention is applied. In FIG. 1, reference numeral 1 designates an internal combustion engine, to which an intake pipe 2 is connected. Arranged across the intake pipe 2 is a throttle body 3, in which a throttle valve 3' is accommodated. A throttle valve opening $\theta_{TH}$ sensor 4 is connected to the throttle valve 3' for supplying an electric signal indicative of the sensed throttle valve opening $\theta_{TH}$ to an electronic control unit (hereinafter called "the ECU") 5.

Fuel injection valves 6, only one of which is shown, are provided for respective cylinders of the engine in a manner being projected into the interior of the intake pipe 2 at a location between the engine 1 and the throttle body 3 and upstream of intake valves, not shown. The injection valves 6 are connected to a fuel pump, not shown, and also electrically connected to the ECU 5, which in turn controls the fuel injection period of the valves 6.

An intake pipe absolute pressure $P_{BA}$ sensor 8 is provided in communication through a conduit 7 with the interior of the intake pipe 2 at a location downstream of the throttle body 3, for supplying an electric signal indicative of the sensed absolute pressure $P_{BA}$ to the ECU 5. An intake air temperature $T_A$ sensor 9 is inserted into the intake pipe 2 at a location downstream of the absolute pressure sensor 8 for supplying an electric signal indicative of the sensed intake air temperature $T_A$ to the ECU 5.

An engine coolant temperature $T_W$ sensor 10, which may be formed of a thermistor or the like, is mounted in the cylinder block of the engine 1, for supplying an electric signal indicative of the sensed engine coolant temperature $T_W$ to the ECU 5. An engine rotational speed Ne sensor 11 and a cylinder-discriminating CYL sensor 12 are arranged in facing relation to a camshaft or a crankshaft of the engine, neither of which is shown. The engine rotational speed sensor 11 generates a pulse as a TDC signal pulse at each of predetermined crank angles whenever the crankshaft rotates through 180 degrees, while the cylinder-discriminating sensor 12 generates a pulse at a predetermined crank angle of a particular cylinder of the engine 1, both of the pulses being supplied to the ECU 5.

A three-way catalyst 14 is arranged within an exhaust pipe 13 connected to the cylinder block of the engine 1 for purifying noxious components such as HC, CO, and $NO_x$. An $O_2$ sensor 15 as an exhaust gas ingredient concentration sensor is mounted in the exhaust pipe 3 at a location upstream of the three-way catalyst 14 for sensing the concentration of oxygen present in exhaust gases emitted from the engine 1 and supplying an electric signal indicative of the sensed oxygen concentration to the ECU 5.

The ECU 5 comprises an input circuit 5a having functions of shaping waveforms of pulses of input signals from various sensors, shifting voltage levels of input signals from sensors, and converting analog values of the input signals from analog-output sensors into digital signals, etc., a central processing unit (hereinafter called "the CPU") 5b, memory means 5c storing various operational programs to be executed within the CPU 5b as well as for storing various calculated data from the CPU 5b, and an output circuit 5d for supplying driving signals to the fuel injection valves 6.

The CPU 5b operates in synchronism with generation of TDC signal pulses to determine operating conditions of the engine 1 such as a feedback control operating condition and open loop control operating conditions, in response to engine parameter signals supplied from various sensors, and calculate a fuel injection period $T_{OUT}$ for which the fuel injection valves 6 should be opened, in accordance with the determined engine operating conditions and in synchronism with generation of TDC signal pulses, by the use of the following equation (1):

$$T_{OUT}=T_i\times K_{WOT}\times K_{O2}\times K_1+K_2 \quad (1)$$

where Ti represents a basic value of the valve opening period for the fuel injection valves 6, which is determined as a function of the intake pipe absolute pressure $P_{BA}$ and the engine rotational speed Ne.

$K_{O2}$ represents an air-fuel ratio correction coefficient whose value is determined in response to the oxygen concentration in the exhaust gas gases detected by the $O_2$ sensor 15 during feedback control, whereas it is set to respective appropriate predetermined values while the engine is in predetermined operating regions (open loop control regions) other than the feedback control region.

Figure 2:
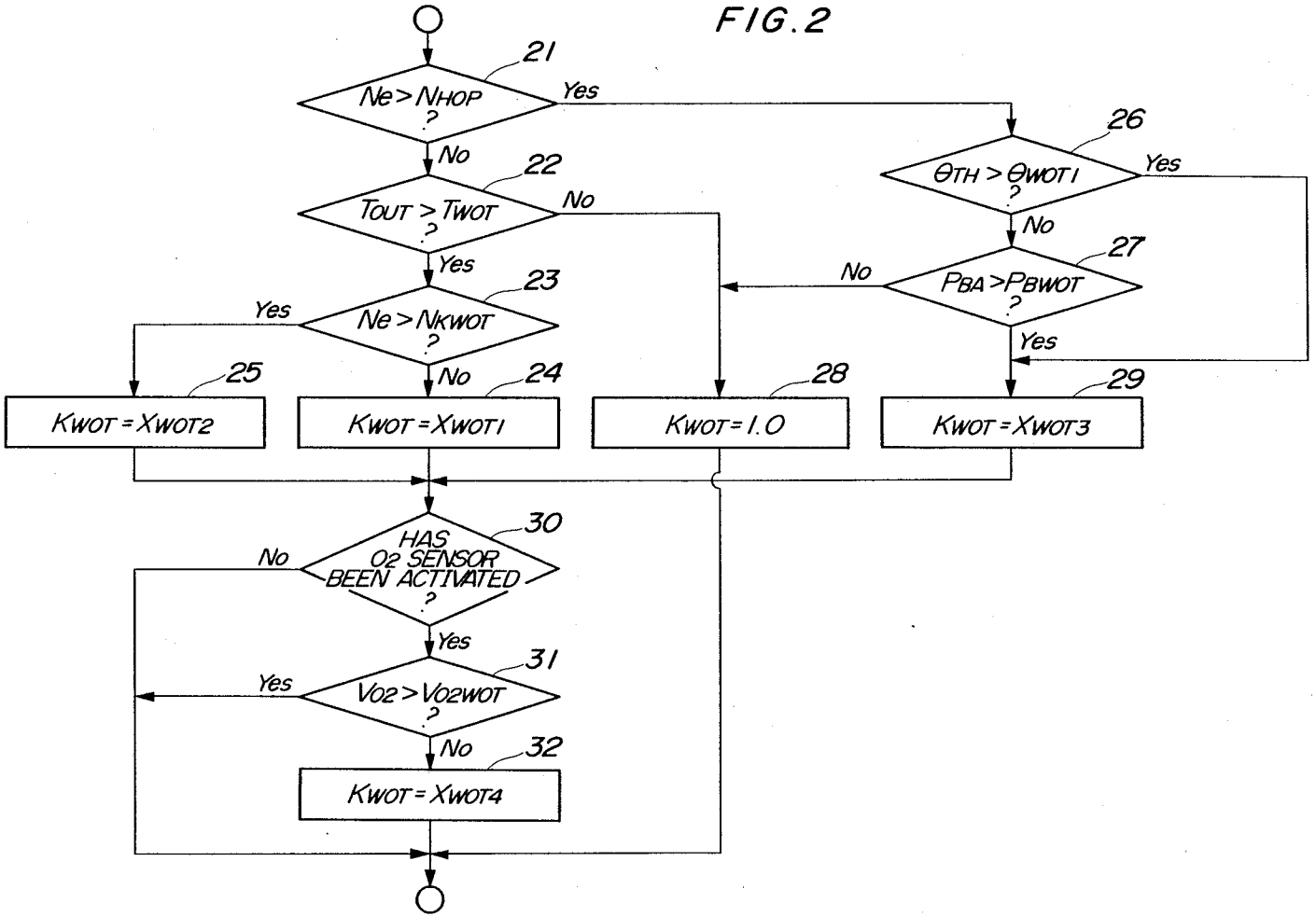
FIG. 2 is a flowchart of a subroutine for calculating a mixture-enriching coefficient $K_{WOT}$ applied during high load condition of the engine; and (a), (b), and (c) of FIG. 3 are graphs showing, by way of example, changes in the output voltage $V_{O2}$ of the $O_2$ sensor, the air-fuel ratio A/F of air-fuel mixture, and the mixture-enriching coefficient $K_{WOT}$.

$K_{WOT}$ represents a mixture-enriching coefficient whose value is determined e.g. in accordance with a subroutine as shown in FIG. 2, hereinafter referred to, during a high load operation of the engine 1 in which the throttle valve 3' is substantially fully open (predetermined high load operating region).

$K_1$ and $K_2$ represent other correction coefficients and correction variables, respectively, which are calculated on the basis of engine operating parameter signals from various sensors to such values as to optimize various operating characteristics of the engine such as fuel consumption and accelerability.

The CPU 5b supplies the fuel injection valves 6 via the output circuit 5d with respective driving signals based on the fuel injection period $T_{OUT}$ calculated as above.

FIG. 2 shows a subroutine for calculating the mixture-enriching coefficient $K_{WOT}$. This program is executed upon generation of each TDC signal pulse and in synchronism therewith.

At a step 21, it is determined whether or not the engine rotational speed Ne is higher than a first predetermined value $N_{HOP}$, e.g. 4200 rpm. If the answer is No, it is determined at a step 22 whether or not the fuel injection period $T_{OUT}$ is longer than a predetermined value $T_{WOT}$. If the answer at the step 22 is No, that is, if $T_{OUT}\leqq T_{WOT}$, the engine 1 is judged not to be in a predetermined high load operating condition, and the mixture-enriching coefficient $K_{WOT}$ is set to a value of 1.0 at a step 28, followed by termination of the program.

If the answer at the step 22 is Yes, that is, if $T_{OUT}>T_{WOT}$, the engine 1 is judged to be in the predetermined high load operating condition, and it is determined at a step 23 whether or not the engine rotational speed Ne is higher than a second predetermined value $N_{KWOT}$, e.g. 3000 rpm. If the answer at the step 23 is No, that is, if $Ne\leqq N_{KWOT}$, the mixture-enriching coefficient $K_{WOT}$ is set, at a step 24, to a first predetermined value $X_{WOT1}$, e.g. 1.23, whereas if the answer is Yes, that is, if $N_{HOP}\geqq Ne>N_{KWOT}$, the mixture-enriching coefficient $K_{WOT}$ is set, at a step 25, to a second predetermined value $X_{WOT2}$, e.g. 1.18, which is smaller than the first predetermined value $X_{WOT1}$, followed by the program proceeding to a step 30. That is, since when $Ne\leqq N_{KWOT}$ holds, the fuel amount has to be increased by a larger amount for acceleration than when $Ne>N_{KWOT}$, the value $X_{WOT1}$ is set at a larger value than the value $X_{WOT2}$.

If the answer at the step 21 is Yes, that is, if $Ne>N_{HOP}$, it is determined at a step 26 whether or not the throttle valve opening $\theta_{TH}$ is larger than a predetermined value $\theta_{WOT1}$, e.g. 64°. If the answer at the step 26 is No, it is determined at a step 27 whether or not the intake pipe absolute pressure $P_{BA}$ is higher than a predetermined value $P_{BWOT}$, e.g. 560 mmHg. If the answer at the step 27 is No, that is, if $P_{BA}\leqq P_{BWOT}$, the engine 1 is judged not to be in a predetermined high load operating condition, followed by the program proceeding to the step 28, whereas if the answer at the step 26 or 27 is Yes, that is, if $P_{BA}>P_{BWOT}$ or $\theta_{TH}>\theta_{WOT1}$, the engine 1 is judged to be in a predetermined high load operating condition, and the mixture-enriching coefficient $K_{WOT}$ is set, at a step 29, to a third predetermined value $X_{WOT3}$, e.g. 1.18, followed by the program proceeding to the step 30. Thus, when the engine is in a high speed region where $Ne>N_{HOP}$ holds, the fuel increasing amount need not be so large, and therefore the value $X_{WOT3}$ is set at a relatively small value.

At the step 30, it is determined whether or not the $O_2$ sensor 15 has been completely activated. If the answer is Yes, it is determined at a step 31 whether or not the output voltage $V_{O2}$ of the $O_2$ sensor 15 is higher than a predetermined value $V_{O2WOT}$, e.g. 0.45 V. If the answer at the step 31 is No, that is, if $V_{O2}\leqq V_{O2WOT}$, which indicates that the air-fuel ratio is on a lean side with respect to a stoichiometric ratio (e.g. 14.7) to which the air-fuel ratio is controlled when the engine is in the feedback control region, it is judged that a gasoline having low volatility is used on the ground that the air-fuel ratio is in the lean side in spite of an increase in the fuel injection amount during the predetermined high load operating condition of the engine 1, and the mixture-enriching coefficient $K_{WOT}$ is set, at a step 32, to a fourth predetermined value $X_{WOT4}$, e.g. 1.35, which is larger than any of the first–third predetermined values $X_{WOT1}$–$X_{WOT3}$, followed by termination of the program. On the other hand, if the answer at the step 30 is No, or if the answer at the step 31 is Yes, which indicates that the $O_2$ sensor 15 has not been activated yet or that the air-fuel ratio is on a rich side, the program is terminated.

As described above, if the output voltage of the $O_2$ sensor 15 is lower than the predetermined value $V_{O2WOT}$ during the predetermined high load operating condition of the engine 1, which indicates that a gasoline having low volatility is used, the mixture-enriching coefficient $K_{WOT}$ is further set to a still larger value to further increase the fuel amount, so that the air-fuel ratio of the mixture is controlled to a desired air-fuel ratio, e.g. 12.0, for the high load operating condition, irrespective of the volatility of gasoline being used.

Figure 3:
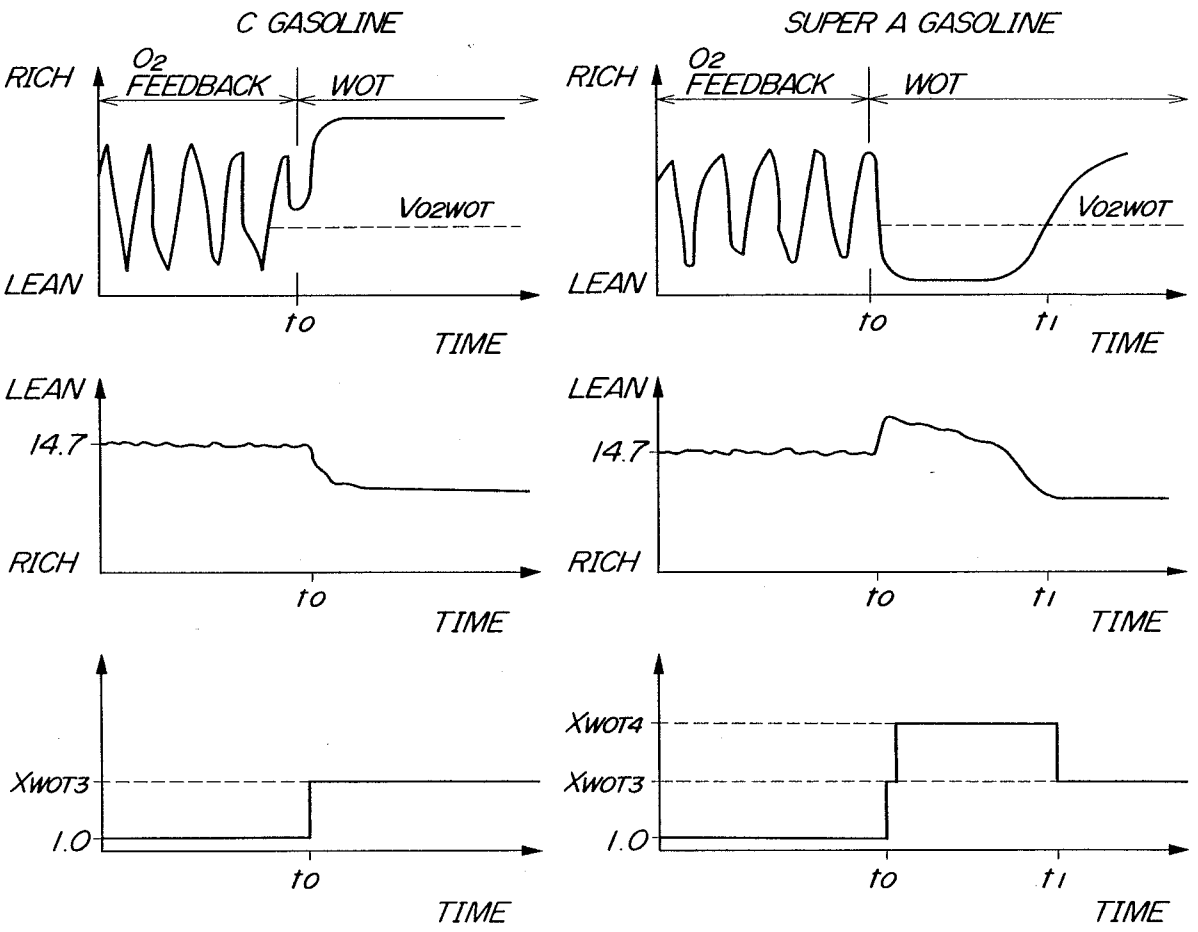

(a), (b), and (c) of FIG. 3 are graphs showing examples of changes in the output voltage $V_{O2}$ of the $O_2$ sensor 15, the air-fuel ratio A/F of the mixture, and the mixture-enriching coefficient $K_{WOT}$, respectively, which are assumed when the engine 1 shifts from the feedback control region to a predetermined high load operating region. The leftside graphs of (a), (b), and (c) show changes taking place when an ordinary gasoline (C gasoline) is used, in which it is seen that the mixture-enriching coefficient $K_{WOT}$ is set to and held at the third predetermined value $X_{WOT3}$ at and after a time point $t_O$, that is, after the engine 1 leaves the feedback control region, whereby the air-fuel ratio of the mixture is enriched to keep the output voltage $V_{O2}$ of the $O_2$ sensor 15 higher than the predetermined value $V_{O2WOT}$.

On the other hand, the right-side graphs of (a), (b), and (c) show changes taking place when a low volatility gasoline (super A gasoline) is used. In this case, although the mixture-enriching coefficient $K_{WOT}$ is once set to the third predetermined value $X_{WOT3}$ at a time point $t_0$, the output voltage $V_{O2}$ of the $O_2$ sensor 15 becomes lower than the predetermined value $V_{O2WOT}$, so that the mixture-enriching coefficient $K_{WOT}$ is immediately set to the fourth predetermined value $X_{WOT4}$. Then, as time elapses, the air-fuel ratio becomes enriched, so that the output voltage $V_{O2}$ exceeds the predetermined value $V_{O2WOT}$ at a time point $t_1$, and the mixture-enriching coefficient $K_{WOT}$ is set again to the third predetermined value $X_{WOT3}$.

Although in the above described embodiment, the control method of the invention is applied to a fuel supply control system in which fuel injection valves are arranged in the intake pipe at locations slightly upstream of the respective intake valves of the engine cylinders, the invention may be applied to another type (e.g. dual-point injection type) fuel supply control system, in which at least two injection valves are provided respectively in the intake pipe at locations downstream and upstream of the throttle valve, to distribute fuel to a plurality of engine cylinders.

As described above, according to the invention, even if a low volatility gasoline is used, it can be prevented that the air-fuel ratio becomes lean, to thereby obtain a desired air-fuel ratio and hence desired engine torque, so that the driveability of the engine can be enhanced.

What is claimed is:

1. In a method of controlling an air-fuel ratio of an air-fuel mixture being supplied to an internal combustion engine having an exhaust passage, and an exhaust gas ingredient sensor arranged in said exhaust passage, wherein when said engine is in a feedback control region, a value of concentration of an exhaust gas ingredient detected by said exhaust gas ingredient sensor is compared with a predetermined reference value, and the air-fuel ratio of said air-fuel mixture is controlled to a desired value in a feedback manner responsive to the comparison result, and when said engine is in a predetermined high load operating region, the feedback control is interrupted and an amount of fuel to be supplied to said engine is increased by a predetermined amount to thereby enrich the air-fuel ratio of said air-fuel mixture, the improvement wherein said predetermined amount is varied depending upon the value of the concentration of said exhaust gas ingredient detected by said exhaust gas ingredient sensor, when said engine is in said predetermined high load operating region.

2. A method as claimed in claim 1, wherein said predetermined amount is increased when said engine is in said predetermined high load operating region and at the same time the value of the concentration of said exhaust gas ingredient detected by said exhaust gas ingredient sensor indicates that the air-fuel ratio of said air-fuel mixture is on a lean side with respect to said desired value.

3. A method as claimed in claim 1, including calculating an amount of fuel to be supplied to said engine, and wherein said engine is determined to be in said predetermined high load operating region when the calculated amount of fuel is larger than a predetermined value.

4. A method as claimed in claim 1, detecting opening of a throttle valve of said engine, and wherein said engine is determined to be in said predetermined high load operating region when the detected opening of said throttle valve is larger than a predetermined value.

5. A method as claimed in claim 1, detecting pressure within an intake passage of said engine, and wherein said engine is determined to be in said predetermined high load region when the detected pressure is higher than a predetermined value.

* * * * *